US006269796B1

(12) United States Patent
Mitchell

(10) Patent No.: US 6,269,796 B1
(45) Date of Patent: Aug. 7, 2001

(54) FLUID FEED SYSTEM

(75) Inventor: Scott Mitchell, Shropshire (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 09/306,745

(22) Filed: May 7, 1999

(30) Foreign Application Priority Data

May 9, 1998 (GB) ..... 9809866

(51) Int. Cl.[7] ..... F02M 55/02
(52) U.S. Cl. ..... 123/468
(58) Field of Search ..... 123/470, 509, 123/472, 469, 468, 446

(56) References Cited

U.S. PATENT DOCUMENTS

| | | | | |
|---|---|---|---|---|
| 4,206,725 | * | 6/1980 | Jenkel et al. | 123/470 |
| 5,297,523 | | 3/1994 | Hafner et al. | 123/456 |
| 5,454,359 | | 10/1995 | Howell | 123/516 |
| 5,499,612 | | 3/1996 | Haughney et al. | 123/470 |
| 5,566,658 | * | 10/1996 | Edwards et al. | 123/470 |
| 5,713,323 | * | 2/1998 | Walsh et al. | 123/184.42 |
| 5,730,101 | * | 3/1998 | Aupperle | 123/321 |
| 5,765,534 | * | 6/1998 | Brown et al. | 123/470 |
| 5,794,595 | * | 8/1998 | Berger et al. | 123/470 |
| 5,803,034 | * | 9/1998 | Gruber et al. | 123/90.38 |
| 5,806,494 | * | 9/1998 | Glassey | 123/456 |
| 6,026,786 | * | 2/2000 | Groff et al. | 123/501 |

FOREIGN PATENT DOCUMENTS 2311814 10/1997 (GB) .

* cited by examiner

*Primary Examiner*—Carl S. Miller
(74) *Attorney, Agent, or Firm*—Alan J. Hickman

(57) ABSTRACT

An apparatus for conveying high pressure actuating fluid such as engine lubricating oil to hydraulically actuated electronically controlled injectors (HEUIs) in an internal combustion engine. The apparatus has a fluid rail with outlet ports to communicate the actuating fluid to the injectors which is adapted to be mountable on an engine so as to be located in use above the actuating fluid inlets of the injectors. A fuel injection system for an internal combustion engine incorporating such apparatus is also described.

5 Claims, 2 Drawing Sheets

Fig. 1
PRIOR ART
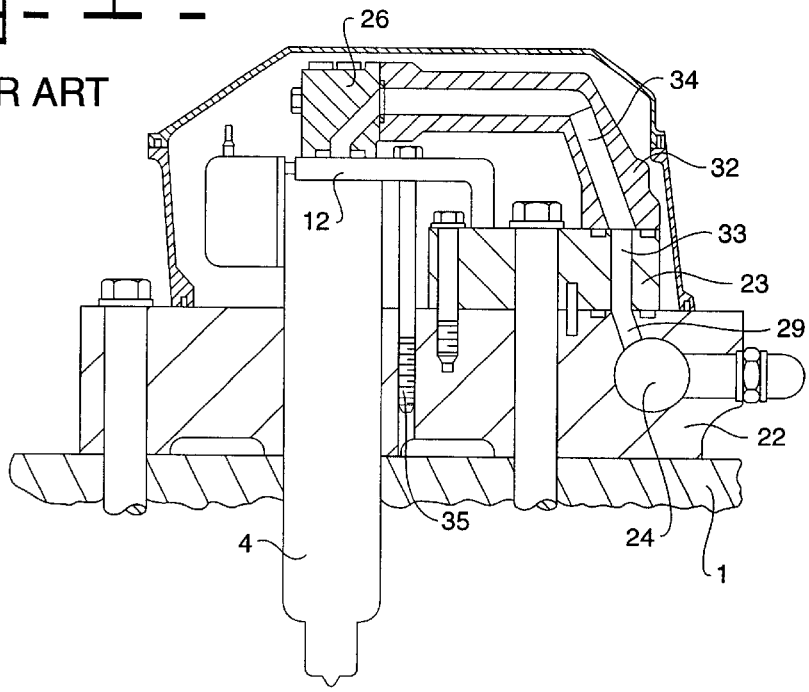
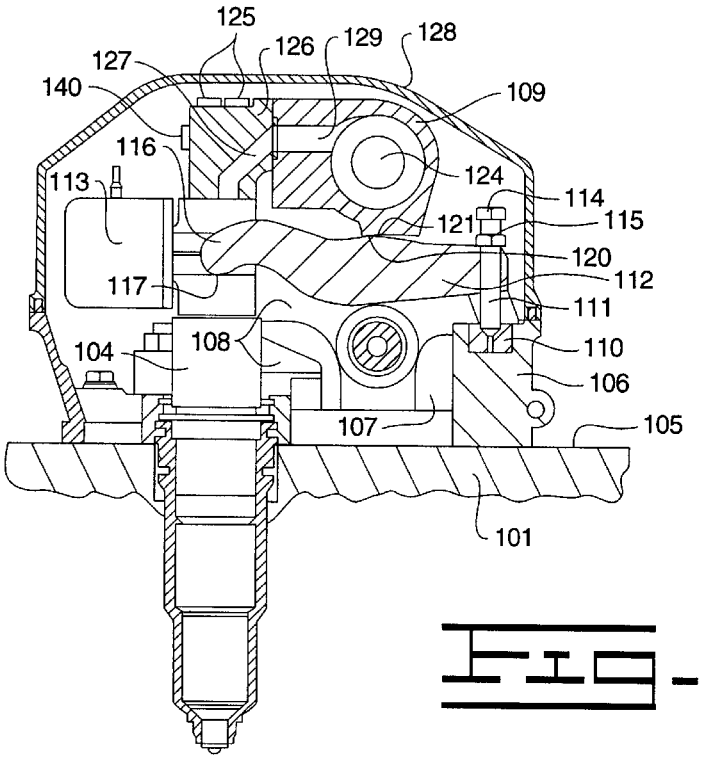
Fig. 2

FLUID FEED SYSTEM

The present invention relates to an apparatus for conveying high pressure fluid, in particular for conveying an actuating fluid to hydraulically-actuated, electronically-controlled, injectors in an internal combustion engine, and to an engine including said apparatus.

Hydraulically-actuated, electronically controlled injection (HEUI) systems utilise a high pressure pump to convey an actuating fluid, preferably oil 'borrowed' from the engine's lubrication system, to a fluid rail (manifold) where it is stored in readiness for actuating the engine injectors under electronic control.

Each injector typically includes an intensifier piston having an upper portion of larger diameter than a lower portion and hence the pressure of the actuating fluid on the upper portion intensifies the pressure of fuel enclosed below the lower portion during an injection event. An electronically-operated valve controls the pressure of the actuating fluid in the fluid rail up to approximately 230 bar and the pressure of the fuel in the injector is correspondingly intensified up to approximately 1500 bar, depending upon the required engine operation characteristics.

Prior HEUI systems have required a fluid rail to be situated remotely from the injectors of the engine, the fluid rail being connected to each injector by a pipe or other form of conduit. Reasons for this include the need for access to injector clamping means. However, disassociation of the rail and the injector has the disadvantages that an undesirable pressure drop may be experienced between these components, there may arise a number of potential leak-points and the engine envelope size may be compromised.

Examples of prior art relating to the above mentioned disadvantages may be seen in FIG. 1 included herewith and in U.S. Pat. No. 5,499,612. In both of these systems a fluid rail in mounted on the cylinder head at a point distant from the injector location. This necessitates the use of a relatively long fluid transfer conduit (the rail branch passage 26 in US 5,499,612 or the jumper block in FIG. 1) to transfer high pressure fluid from the manifold to the injector. This gives rise to the potential problems of leakage, pressure drop and the like set out above.

It is an object of the present invention to provide an actuating fluid feed apparatus between the fluid rail and the injectors in a HEUI system in which the fluid rail is closely adjacent to the injectors to minimise pressure drop.

It is a further object to provide an actuating fluid feed apparatus in which the number of leak-paths is minimised.

It is a yet further object to provide an actuating fluid feed apparatus of a compactness which will minimise engine envelope size.

It is a yet further object to provide an actuating fluid feed apparatus which enables injector removal for servicing with minimal disturbance to the remainder of the high pressure fluid feed system.

According to one aspect of the invention an apparatus for conveying high pressure actuating fluid to a hydraulically actuated electronically controlled injector in an internal combustion engine, comprising a fluid rail defining an actuating fluid reservoir and having an outlet port connectable to communicate actuating fluid to an actuating fluid inlet of an injector and fluid rail support means adapted to be mountable on an engine and so configured that when so mounted in use the fluid rail is located above the actuating fluid inlet of the injector.

In this configuration the fluid rail is lifted above the injector and can be located closely adjacent to the injector thus reducing pressure drop associated with the prior art arrangements where the rail is fixed to the cylinder head some distance from the injector. This also opens up a number of possibilities for clamp and injector design which will permit easy removal of the injector for servicing with minimal disturbance to the high pressure fluid feet system itself.

Engines of this type may incorporate a rocker box which sits on the cylinder head of the engine. Alternatively, the rocker box may be defined by walls integral with, and extending upwardly from, the cylinder head. Preferably the apparatus for conveying high pressure actuation fluid further comprises a rocker box engagable with or formed by walls extending upwardly from the upper surface of a cylinder head of an engine and comprising integral fluid rail support means.

The fluid rail support means are conveniently in the form of a plurality of pedestals.

Preferably the fluid rail has a plurality of fluid outlet ports. This allows a single fluid rail to communicate actuating fluid to a plurality of injectors the number of fluid outlet ports corresponding in numbers to the injectors to be fed with actuation fluid by that fluid rail.

It has already been mentioned that engine lubricating oil is the preferred fluid for actuating the injectors. If the engine fuel were to be used for activation, a secure means would need to be provided for transfer of the fuel from the intensifier back to the tank. Further, the temperature increase within the fuel, brought about by the intensification event, could be detrimental to engine operation when the fuel was subsequently injected into the engine.

When using lubricating oil for activation, the oil is dispensed from the injector following the actuation event and may be returned to the engine sump for cooling by normal engine oil cooling means and subsequently re-used. Conveniently, oil drain means are provided to return the oil to the engine sump. If the injector is situated within an enclosed volume of the engine, it is possible to use the engine's conventional existing oil drain means to return the oil.

In accordance with a second aspect of the invention a hydraulically actuated fuel injection system for an internal combustion engine comprises an injector, an apparatus as above described for conveying actuating fluid to the injector, clamping means for clamping the injector in place comprising a clamp having a first end adapted to engage the body of the injector, clamp support means adapted to locate the clamp in position on an engine and clamp force applying means to engage the clamp so as to apply a clamping load to the injector body.

To ensure that sufficient space is provided in the engine to locate the fluid rail closely adjacent to the injectors the clamp support means are preferably located distant from the first end and more preferably substantially at the second end of the clamp. The clamp force applying means are adapted to engage the clamp at a location distant from the first end and more preferably substantially at the second end of the clamp. The fluid rail support means are preferably so configured that in use fitted to an engine the fluid rail is located above the clamp arm between the injector and the clamp force applying means.

The clamp and fluid rail are adapted to engage together in a point of rolling contact to provide a fulcrum point through which the clamping load is transferred from the force applying means through the first end of the clamp to the injector body. Preferably the fulcrum point is located between the first end and the clamp force applying means.

Preferably the fulcrum comprises a curved upper surface portion on the clamp adapted to engage a planar lower surface on the fluid rail.

By way of example, the invention will be described with reference to the accompanying drawings of which:

FIG. 1 is a view of a known HEUI system fitted to an engine, including a known injector oil feed apparatus and injector clamping means;

FIG. 2 is a cross-sectional end view through an upper part of an engine fitted with the apparatus of the present invention;

Figure 3:
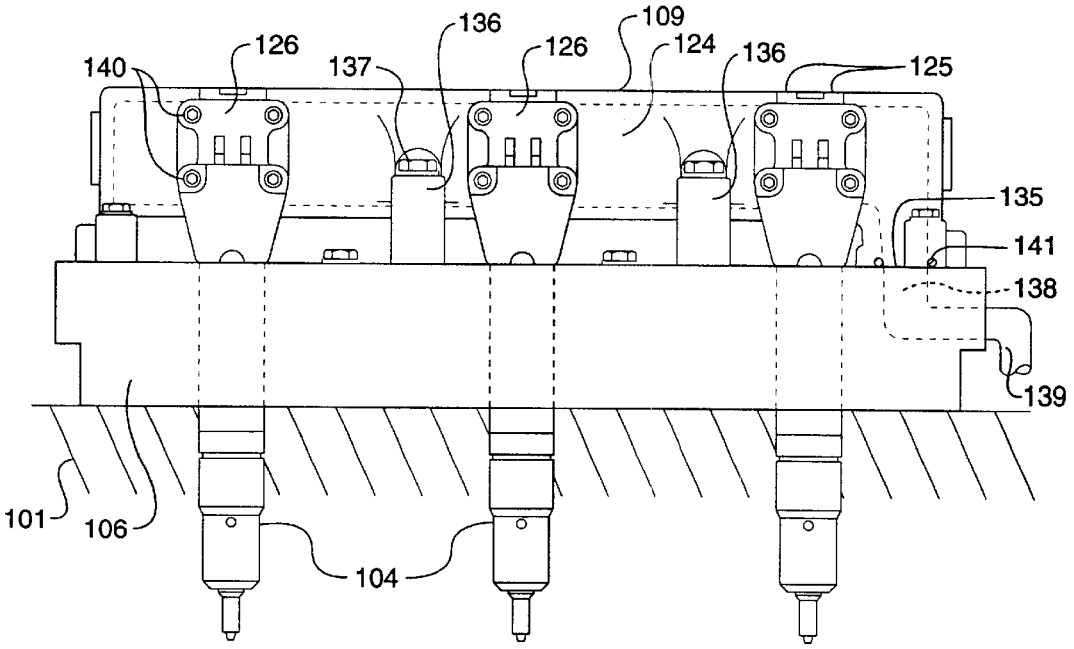
FIG. 3 is a side view of the apparatus of FIG. 2 with the top cover and gas exchange valve mechanism removed for clarity.

Referring to the drawings, FIG. 1 shows a known hydraulically actuated, electronically controlled, unit injector (HEUI) and a known actuating oil feed apparatus. It may be seen in this arrangement that affixed to a cylinder head 1 is an oil supply body 22 including a high pressure oil rail 24. Mounted to an upper face of the oil supply body is a rocker arm base 23 upon which is mounted a jumper block 32.

The high pressure oil rail 24 fluidly connects via passages 29, 33, 34 within the oil supply body 22, rocker arm base 23 and jumper block 32 to a transfer block 26. The transfer block mechanically and fluidly connects the jumper block to an injector 4. The injector is retained to an engine by a clamp 12, itself retained by at least one threaded fastener 35 engaging with the oil supply body.

The known apparatus has several disadvantages in that it includes an oil supply body which requires machining of at least upper and lower faces and then fastening and sealing to a cylinder head of the engine; it has a number of potential leak-paths between oil supply component interfaces; any attempts to minimise engine width may be compromised by the outward extent of the oil supply body and further, the jumper block may need removing to give access to the injector clamp for injector servicing, thus disturbing the rocker arm base to jumper block seal.

In U.S. Pat. No. 5,499,612 the disclosed injector clamp can be removed and replaced without disturbing the oil supply system but it will be necessary to remove rail branch passage 26 in order to remove and refit the injector, thus increasing the risks of oil leakage subsequent to re-assembly.

Further, though the number of sealed interfaces in the oil supply system of '612 are less in number than those of the known apparatus of the present FIG. 1, tubular flared connections have been employed to manage any angular misalignment at each end of the rail branch passage and this method of fluid sealing is not generally as robust as a ring seal clamped between two rigid components.

Figure 4:
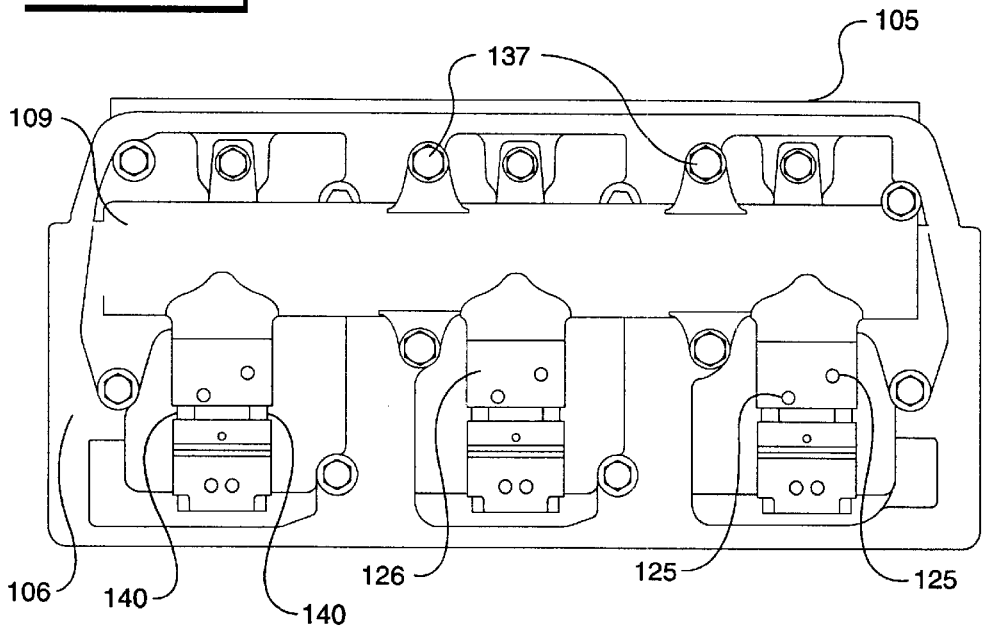
FIG. 4 is a plan view of the apparatus of FIG. 3.

The disadvantages described in the preceding three paragraphs may be eliminated or alleviated in the present invention which will now be described with reference to FIGS. 2, 3 and 4.

A rocker box 106 is mounted to an upper face 105 of a cylinder head 101 of an engine which in this example has a number of cylinders each provided with an injector 104. The rocker box defines a volume 107 within which will be contained one or more gas exchange valve operating mechanisms 108 (of which only a portion may be seen) and above which will be contained the apparatus of the present invention. The gas exchange valve operating mechanisms 108 will be fitted to the engine in the conventional manner, followed by fitment of the apparatus of the present invention in a manner to be described.

An oil rail 109 defining an internal reservoir 124 includes an oil inlet port 135 and a number of oil outlet ports 129 corresponding in number to the injectors to be fed with oil. Pedestals 136 are provided arising from and integral with the rocker box. The oil rail is fitted to the pedestals 136 and is retained thereto by means of threaded fasteners 137. Alternatively (not shown) the oil rail may be retained by threaded fasteners which pass through the rocker box and into the cylinder head, thus securing both oil rail and rocker box to the engine. In this example the injectors form a linear array and the rail 109 is positioned parallel to the plane of the array.

The inlet port 135 in the oil rail corresponds with an oil feed passage 138 within the rocker box, the interface being made oil-tight by sealing ring 141 or other conventional means. A conduit 139 to the rocker box passage from an oil pump (not shown) is provided in a conventional manner.

Following the fitment of the oil rail, each injector 104 complete with electronic control valve 113 may be positioned in the cylinder head and clamped down to the required axial load by a clamp 112. One end 116 of the clamp 112 is adapted to engage shoulders 117 on the injector 104. A promontory 120 on the upper surface of the clamp engages a pad 121 on the oil rail 109 as a fulcrum. The clamp, and thus the injector, is securely retained by clamp support means consisting of a screw 114 through a threaded hole 111 at an outer end of the clamp retained in place by a locknut 115. This configuration increases the space available for fitment of the oil rail closely adjacent to the injector. It should be noted that the clamping apparatus and method is the subject of a separate patent application by the present applicant.

Oil transfer blocks 126 are then positioned to mechanically and fluidly connect the oil rail to each injector respectively via channels 127,129 and may be retained on the injector by threaded fasteners 125 and on the oil rail by threaded fasteners 140. Though any leakage of oil via the fluid interfaces will spill into the volume 107 defined by the rocker box 106 and drain back to the engine sump (not shown) in a conventional manner, oil leakage may affect the performance of the injection system and therefore sealing with sealing rings or other conventional means may be necessary. A cover 128 may then be affixed to the rocker box 106 in a conventional manner.

When servicing of an injector is required, it is a simple matter to remove the rocker box cover 128, transfer block 126, injector clamp 112 and injector 104.

Other than removal and subsequent refitting of the transfer block, no part of the HEUI actuating oil conveying system needs to be disturbed during injector servicing.

What is claimed is:

1. An apparatus for conveying high pressure actuating fluid to a hydraulically actuated electronically controlled injector in an internal combustion engine, comprising:

a fluid rail defining an actuating fluid reservoir and having an outlet port connectable to communicate actuating fluid to an actuating fluid inlet of an injector;

a cylinder head having a face;

a gas exchange valve operating mechanism being mounted on the cylinder head and extending above the face;

fluid rail support connected to the cylinder head and locating said fluid rail above the gas exchange valve operating mechanism, above the actuating fluid inlet of the injector, above the face, and closely adjacent the injector.

2. An apparatus, as set forth in claim 1, including:

a rocker box having a plurality of walls disposed about the gas exchange valve operating mechanism, the injector and the fluid rail, said walls being engaged with the face of the cylinder head and extend upwardly from said face;

said fluid rail support being connected to the walls of the rocker box and defining a plurality of pedestals, said fluid rail being supported on said pedestals; and a plurality of fasteners connecting the fluid rail to the pedestals.

3. An apparatus, as set forth in claim 2, wherein a selected ones of said plurality of fasteners extend through a hole in said pedestals and screwthreadably secure the rocker box and the fluid rail to the cylinder head.

4. An apparatus, as set forth in claim 2, including:

an inlet port disposed in said rocker box; and an oil feed passage provided in said rocker box, said plurality of fasteners maintaining said inlet port and said oil feed passage in aligned and sealed fluid passing communication with each other.

5. An apparatus, as set forth in claim 2, wherein said injector having a shoulder and being disposed position in the cylinder head, and including:

a clamp having a first end portion, a second end portion spaced from the first end portion and a fulcrun point located between the first and second end portions of said clamp, said first end portion being engaged with the shoulder of the fuel injector;

a clamp support located on the rocker box;

a fulcrun pad located on the rail at a location beneath the rail and between the face of the cylinder head and the rail, said clamp being disposed beneath the rail with said fulcrum point being engaged with the fulcrum pad;

a force applying device connected to the second end of the clamp and engageable with the clamp support, said force applying device urging the clamp about the fulcrum point and the first end portion into force engagement with the shoulder, said clamp maintaining the injector in position in said cylinder head.

* * * * *